United States Patent [19]

Rackham et al.

[11] 4,383,499

[45] May 17, 1983

[54] CAST METAL HEAT EXCHANGER AND METHOD OF FORMATION

[75] Inventors: Michael Rackham, Leamington Spa; William C. Habgood, Cubbington, both of England

[73] Assignee: Potterton International Limited, Warwick, England

[21] Appl. No.: 320,498

[22] Filed: Nov. 12, 1981

Related U.S. Application Data

[62] Division of Ser. No. 41,375, May 22, 1979, abandoned.

[30] Foreign Application Priority Data

May 26, 1978 [GB] United Kingdom ..... 23025/78

[51] Int. Cl.[3] ..... F22B 15/00

[52] U.S. Cl. ..... 122/18; 122/20 B; 122/176; 126/361; 165/165

[58] Field of Search ..... 122/13 R, 18, 20 B, 122/48, 155 R, 155 A, 172, 176, 177; 126/361; 237/55; 165/130, 165, DIG. 2, DIG. 8

[56] References Cited

U.S. PATENT DOCUMENTS

| | | | |
|---|---|---|---|
| 1,988,224 | 1/1935 | Wendel | 165/165 |
| 2,343,387 | 3/1944 | Sargent et al. | 165/130 |
| 2,586,118 | 2/1952 | Teller | 165/165 |
| 4,106,693 | 8/1978 | Oliver | 165/DIG. 2 |
| 4,126,105 | 11/1978 | Böttcher | 165/130 |

FOREIGN PATENT DOCUMENTS

| | | | |
|---|---|---|---|
| 295881 | 5/1911 | Fed. Rep. of Germany | 165/130 |
| 1285707 | 12/1968 | Fed. Rep. of Germany | 165/130 |
| 1579880 | 8/1970 | Fed. Rep. of Germany | 165/130 |
| 1598236 | 6/1970 | France | 165/130 |
| 318193 | 12/1929 | United Kingdom | 122/176 |
| 378332 | 8/1932 | United Kingdom | 165/165 |
| 398071 | 9/1933 | United Kingdom | 165/130 |
| 450188 | 7/1936 | United Kingdom | 122/20 B |
| 953436 | 3/1964 | United Kingdom | 122/155 A |
| 1262932 | 2/1972 | United Kingdom | 165/165 |
| 1265792 | 3/1972 | United Kingdom | 165/165 |
| 1319006 | 5/1973 | United Kingdom | 165/130 |
| 1484923 | 8/1977 | United Kingdom | 165/165 |

OTHER PUBLICATIONS

Etegenheizkessel, Skunca et al., Ikz, vol. 25, Nr. 23, Arnsberg, 1970, pp. 26, 28, 30, 32.

*Primary Examiner*—Sheldon J. Richter

*Attorney, Agent, or Firm*—Steele, Gould & Fried

[57] ABSTRACT

A cast metal heat exchanger (e.g. of iron or aluminum) for a hot water boiler having a plurality of flueways and waterways and which is rectangular in plan view down onto the flueways with the waterways extending parallel to the minor rectangular axis. A method of manufacturing a cast metal waterway section of cuboid volume less than 4500 mls for a heat exchanger (which comprises casting the metal into a mould with the waterway core vertically disposed. A heat exchanger comprising a plurality of such sections can be formed integrally by vertically casting such a plurality simultaneously in one mould.

8 Claims, 3 Drawing Figures

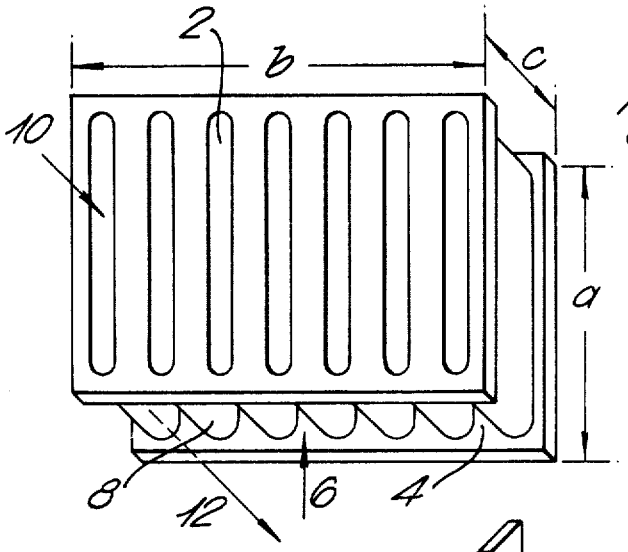
Fig. 1.
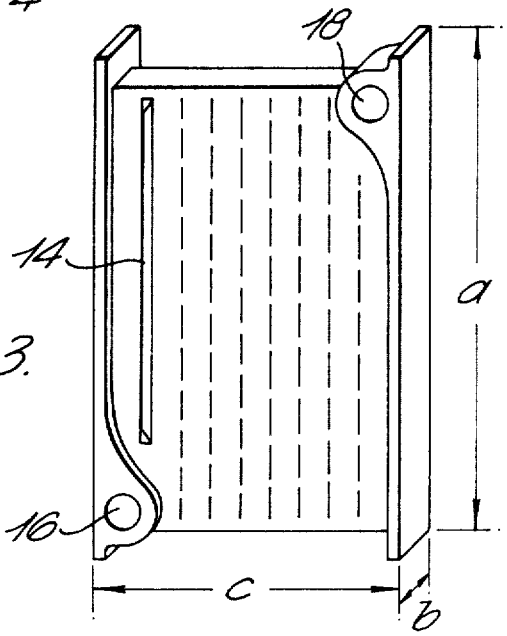
Fig. 3.
Fig. 2.
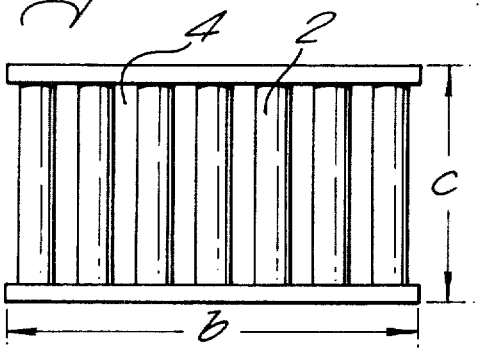

CAST METAL HEAT EXCHANGER AND METHOD OF FORMATION

This is a division, of application Ser. No. 41,375, filed May 22, 1979, now abandoned.

BACKGROUND OF THE INVENTION

1. Field of the Invention

This invention relates to cast heat exchangers for hot water boilers and to a method of making such heat exchangers.

2. Discussion of the Prior Art

Hot water boilers, such as used in domestic central heating systems, employ a heat exchanger to transfer the heat from the burning fuel to water. Although heat exchangers based upon sophisticated materials and designs have been proposed and sometimes employed, the use of conventional cast heat exchangers with flueways and waterways is still prevalent, and indeed is preferred in many parts of the heating industry.

Such cast heat exchangers are normally (in the U.K.) formed of cast iron and, as such, are relatively heavy objects. An increasing trend in the market (especially for domestic systems) is for small, wall-mounted boilers and it goes without saying that there is a need for an efficient, relatively lightweight cast heat exchanger.

Efficiency of heat exchange and weight of cast metal are, to an extent, factors which contradict one another. Efficiency of heat exchange dictates a large surface area of cast metal in contact with hot fuel, yet any increase in this surface area can be locked upon as tending to increase the amount of cast metal required, and thus increasing the weight of the heat exchanger.

A typical wall-mountable domestic hot water boiler is the Potterton "Netaheat" (Trade Mark). This has a cast iron heat exchanger approximately 25 cm high, 18 cm wide (measured perpendicular to the wall-mounting surface), and 32 cm long (measured parallel to the wall-mounting surface). It has three connecting waterways and two flueways interposed between the waterways. This heat exchanger has a capacity of 13,200 to 16,100 W heat input into water with a non-fan assisted flue and this approximates to a heat input/weight of heat exchanger ratio of 340 W:kg of cast iron. It is to be observed that this heat exchanger is generally rectangular when viewed in plan (i.e. down onto the flueways) and the flueways run parallel to the longest axis: this arrangement is customary in the industry.

The "Netaheat" heat exchanger, in common with probably all cast heat exchangers, has two distinguishable types of heat exchange surface. The surfaces which may be said to form the walls of the flueways and contact most directly with the waterways can be termed "primary heat-exchange surfaces", whereas the surfaces which extend into the flueways from the primary heat-exchange surfaces (such surfaces being fins or the like) can be termed "secondary heat-exchange surfaces". The "Netaheat" heat exchanger has approximately 400 sq. in. (2,600 sq. cm.) of primary heat-exchange surface.

To manufacture heat exchangers such as the one described, the waterway sections can be cast separately in moulds and then subsequently assembled to provide the heat exchanger, or the sections can be cast together in one mould to provide an integrally-formed heat exchanger. The technique currently employed is to cast the waterways horizontally—that is to say, the two opposing walls of largest surface area are cast and formed horizontally, one above the other. As the molten metal is poured into the mould first one, then the next of these walls is formed. If a single waterway section is being formed obviously only two such walls exist and are formed, but if a heat exchanger comprising a plurality of waterways is being formed integrally, then each such waterway wall forms in the mould successively as the mould fills with molten metal. At any one time during moulding unequal pressure is exerted on the cores forming the waterways and experience has shown that these cores can bow under pressure of the metal. For this reason it has been customary to produce thicknesses for the majority of the walls in the heat exchanger no less than about 5 or 6 mm (for cast iron).

With the ever-rising cost of fuel for central heating purposes, the industry is facing demands for higher efficiency standards. To supply this there is a need to provide heat exchangers having closer tolerances in design criteria than in the past. The cost of the raw materials such as the iron for casting is also a factor to be taken into account. There is thus a need for cast metal heat exchangers using less metal than previously and which, at the same time, can be formed to the closer tolerances required thus enabling higher efficiency boilers to be produced.

SUMMARY OF THE INVENTION

An object of the invention is to provide an improved heat exchanger which can be accurately formed with relatively thin heat exchange walls (less than the 5 or 6 mm quoted above) and which has good heat exchange characteristics.

We have produced such a heat exchanger by means of two factors. The first of these factors has been a rearrangement of the customarily-employed heat exchange surfaces. The second factor is a novel casting technique for these heat exchangers. Both factors form separate aspects of the invention.

As mentioned above, heat exchangers are often rectangular in plan view and the flueways customarily extend parallel to the major rectangular axis. We have discovered that by turning the flueways through 90° so that they extend parallel to the minor rectangular axis, a large increase in heat input capacity arises. The explanation for this appears to arise from the concomitant increase in primary heat exchange surface obtained. For example, with a heat exchanger of dimensions similar to those in the "Netaheat" boiler, this re-arrangement of flueways can increase the primary heat exchange surface from about 2,600 sq. cm. to 4,550 sq. cm.

According to a first aspect of the invention we provide a cast metal heat exchanger for a hot water boiler having a plurality of interposed waterways and flueways and of generally rectangular configuration when viewed in plan down onto the flueways, characterised in that the flueways are disposed parallel to the minor axis of the rectangle.

The novel casting technique has been to turn the disposition of the cores through 90° in relation to the direction of casting of the metal: the waterways are now cast vertically. In this fashion the waterways are cast simultaneously and equal pressure is exerted on each side of the waterway cores as the mould is filled. The core bowing problem no longer arises and it has been found that it is safe to reduce thicknesses for the majority of the walls to about 4 mm (with cast iron) without detriment. This technique itself therefore reduces weight in the cast heat exchanger.

Such vertical casting is probably itself not a completely novel technique, but it appears never previously to have been considered for casting small waterway sections or small heat exchangers. The reason for this is not clear, but we have discovered that substantial advantages arise when it is employed for such small sections (for subsequent assembly into a complete heat exchanger) or for integrally-formed small heat exchangers as are designed, for instance, to be well-mounted.

According to a second aspect of the invention we provide a method of manufacturing a cast metal waterway section of a heat exchanger which has a generally cuboid configuration and cuboid volume for the waterway section of no greater than 4500 mls., which method comprises casting molten metal into a mould having a mould core which will ultimately form the waterway in the section, characterised in that the core is disposed vertically whereby the two opposing walls of largest surface area of the waterway section are simultaneously cast and formed vertically, the majority of the primary heat exchange surfaces having a thickness no greater than approximately 4 mms.

Although turning the flueways through 90° and turning the casting for the waterways through 90° are individually straightforward techniques the combination can provide quite radical improvements to the heat exchangers produced.

Preferably heat exchangers according to the invention are formed of cast iron, but the invention also applies to cast aluminium especially for those countries where aluminium rather than iron heat exchangers are common.

The heat exchanger may be formed as an integral unit (i.e. cast as one unit) or it may be formed from separate cast sections subsequently fitted together.

The flueways may be provided with secondary heat exchange surfaces such as fins, if desired, but it is considered that the ratio of secondary to primary surfaces employed will possibly be less than that employed with previous heat exchangers.

The heat exchanger may be employed with any burning fuel, although gas is preferred.

BRIEF DESCRIPTION OF THE DRAWINGS

Preferred features of the invention will now be described with reference to the accompanying drawings given by way of example, wherein:

FIG. 1 illustrates schematically a heat exchanger according to the invention for use in a gas-fired hot water boiler, view in perspective from below;

FIG. 2 shows the heat exchanger of FIG. 1 when viewed in plan; and

FIG. 3 shows a single waterway section which may be formed according to the method of the invention and then assembled to form a heat exchanger such as illustrated in FIGS. 1 and 2.

DESCRIPTION OF THE PREFERRED EMBODIMENT

Referring first to FIGS. 1 and 2, a heat exchanger according to the invention is illustrated. For clarity, an end face of the heat exchanger has been removed to show the waterways, and the gas burner, secondary heat exchange surfaces and various connections to the water system are also not shown.

The heat exchanger has seven waterways 2 and six flueways 4. The burnt gas proceeds upwards through the flueways 4 in the direction shown by the arrow 6. The heat exchanger is generally cuboid in configuration and rectangular in plan (FIG. 2). The flueways 4 extend parallel to the minor rectangular axis. The base of one of the primary heat exchange surfaces is indicated at 8. Water to be heated enters the base of the waterways (e.g. in the direction shown by arrow 10) and leaves heated from the top of the waterways (e.g. in the direction shown by arrow 12). The dimensions of the heat exchanger are typically a=25 cms b=35 cms c=20 cms. Since seven waterways are present in the heat exchanger, each waterway section can be ascribed the dimensions a=25 cms, b=5 cms, c=20 cms, i.e. a cuboid waterway section volume of 2500 mls. The volume of the entire heat exchanger is 17,500 mls.

The heat exchanger is cast from iron as an integral unit in a mould with sand cores for the waterways and flueways. The waterway cores are disposed in the mould vertically so that, in fact, the molten metal fills the mould in the direction indicated by arrow 6 in FIG. 1. The primary heat exchange surfaces for the heat exchanger (the walls of the waterway sections) are 4 mm thick.

A single waterway section is shown in FIG. 3. The walls of the waterway section are provided with fins 14, only one of which is shown, but the position of other fins is schematically shown by means of dashed lines. Water inlets and outlets are indicated at 16 and 18. The waterway section is cast in the upright position shown in FIG. 3, has 4 mm wall thicknesses for the primary heat exchange surfaces and has dimensions a=25 cms, b=5 cms, c=20 cms. Any number of these sections may be fitted together to form a heat exchanger. For example, seven would provide a heat exchanger somewhat as illustrated in FIGS. 1 and 2. It is important to note that although sufficient can be assembled together to give a heat exchanger which is rectangular in plan view and with the flueways parallel to the minor axis, this is not essential. For example, two or three of the sections shown in FIG. 1 might be assembled, thus making the flueways parallel to the major axis in plan.

We claim:

1. A cast metal heat exchanger in combination with a hot water boiler having a fuel burner from which hot exhaust gases rise and pass in thermal engagement through the heat exchanger, the heat exchanger comprising:

a plurality of substantiallly cuboid cast metal waterway sections, each of the waterway sections having a cuboid volume not greater than 4,500 mls.;

the waterway sections being interconnected at spaced intervals so as to define unobstructed and substantially cuboid flueways therebetween;

the heat exchanger and the individual waterway sections and flueways being rectangular when viewed in plan, transverse to the direction of movement of the hot rising exhaust gases, the major axes of the viewed rectangles of the individual waterway sections and flueways being disposed parallel to the minor axis of the viewed rectangle of the heat exchanger;

and, walls of the cast metal waterway sections forming a majority of primary heat exchange surfaces having a thickness not greater than 4 mms., whereby more efficient transmission of thermal energy from the hot gases to water flowing through the heat exchanger can be achieved notwithstanding the small size and volume of the heat exchanger.

2. A cast metal heat exchanger in combination with a hot water boiler according to claim 1, wherein the heat exchanger is formed of cast iron.

3. A cast metal heat exchanger in combination with a hot water boiler according to claims 1 or 2, wherein each of the waterway sections is an individual casting.

4. A cast metal heat exchanger in combination with a hot water boiler according to claims 1 or 2, wherein all of the waterway sections are a single casting, thereby providing an integrally formed heat exchanger.

5. A cast metal heat exchanger in combination with a hot water boiler according to claim 1, wherein secondary heat exchange surfaces extend perpendicularly from the walls of the waterway sections into the flueways.

6. A cast metal heat exchanger in combination with a hot water boiler according to claim 5, wherein the secondary heat exchange surfaces are a series of straight fins extending parallel to the direction of movement of the hot rising exhaust gases.

7. A cast metal heat exchanger in combination with a hot water boiler according to claim 1, wherein the cuboid volume of each of the waterway sections is not greater than 2,500 mls.

8. A cast metal heat exchanger in combination with a hot water boiler according to claim 1, wherein the entire heat exchanger has a cuboid volume not greater than 17,500 mls.

* * * * *